US006956583B2

(12) United States Patent
Lee

(10) Patent No.: US 6,956,583 B2
(45) Date of Patent: Oct. 18, 2005

(54) ERROR DIFFUSION METHOD AND APPARATUS THEREOF FOR DISPLAY SYSTEM

(75) Inventor: Jae Hyuck Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/105,152

(22) Filed: Mar. 25, 2002

(65) Prior Publication Data

US 2002/0190999 A1 Dec. 19, 2002

(30) Foreign Application Priority Data

Jun. 14, 2001 (KR) ..... 2001-33541

(51) Int. Cl.[7] ..... G09G 5/00; G06K 9/48; G06K 9/38; G06K 9/46; G06K 9/36

(52) U.S. Cl. ..... 345/616; 382/199; 382/252

(58) Field of Search ..... 345/606, 616, 345/611; 382/199, 200, 252; 358/465, 466

(56) References Cited

U.S. PATENT DOCUMENTS 5,379,130 A * 1/1995 Wang et al. ..... 358/462
5,757,517 A * 5/1998 Couwenhoven et al. .... 358/463
5,760,794 A * 6/1998 Munson et al. ..... 345/522
6,577,759 B1 * 6/2003 Caron et al. ..... 382/164
2002/0006231 A1 * 1/2002 Jayant et al. ..... 382/266

* cited by examiner

*Primary Examiner*—Matthew C. Bella
*Assistant Examiner*—Aaron M. Richer
(74) *Attorney, Agent, or Firm*—Lee, Hong, Degerman, Kang & Schmadeka

(57) ABSTRACT

In an error diffusion method and an apparatus thereof for a display system capable of preventing errors of pixels of a certain display region for being affected by pixels of other display regions on a PDP (plasma display panel) device or other display devices, the apparatus includes a boundary region recognition unit for recognizing boundaries of displayed regions by a RGB (red, green, blue) input signal and outputting a boundary recognition signal and an error diffusion processing unit for outputting a RGB output signal by computing an error value between a present pixel and surrounding pixels or outputting a RGB output signal by computing only an error value of the present pixel according to the boundary region recognition signal.

16 Claims, 4 Drawing Sheets

ERROR DIFFUSION METHOD AND APPARATUS THEREOF FOR DISPLAY SYSTEM

CROSS-REFERENCE TO RELATED APPLICATIONS

Pursuant to 35 U.S.C. § 119(a), this application claims the benefit of earlier filing date and right of priority to Korean Application No. 33541/2001, filed on Jun. 14, 2001, the contents of which is hereby incorporated by reference herein in their entirety.

BACKGROUND OF THE INVENTION

1. Field of the Invention

The present invention relates to a display system, and in particular to an error diffusion method and an apparatus thereof for a display system which are capable of preventing errors of pixels in a certain display regions from affecting pixels of other display regions on a PDP (plasma display panel) device or other display devices.

2. Description of the Prior Art

Generally, in order to implement a gray-level on a PDP (plasma display panel) device or other display devices, an error diffusion algorithm is applied to an error diffusion method and an apparatus thereof for a display system.

When there is an error in a gray-level, the error diffusion algorithm is used in order to implement visually the gray-level having the error on a display device. Herein, each pixel transmits its error to surrounding pixels, a gray-level having errors in wide regions can be visually implemented. Typically, a Floid-Steinberg algorithm is widely used.

In the Floid-Steinberg algorithm, a gray-level is implemented by multiplying a coefficient by an error value between three pixels placed the upper horizontal line and a left pixel centering around a present pixel and adding an error value of the present pixel in accordance with a carry occurrence. It is widely used for displaying of a gray-level having an error. Herein, the coefficient multiplied by an error value between three pixels in the upper horizontal line and a left pixel centering around the present pixel is an optimum value determined by considering visual characteristics of human body. The Floid-Steinberg algorithm will be described with reference to accompanying FIG. 1.

FIG. 1 is a block diagram illustrating an error diffusion applying the Floid-Steinberg algorithm.

As depicted in FIG. 1, a pixel 5 illustrates an error of a present pixel, and a pixel 1~a pixel 4 illustrate errors of surrounding pixels.

An accumulated error of the present pixel is calculated by multiplying a coefficient by the pixel 1~the pixel 4 as the errors of the surrounding pixels and adding the pixel 5 as an error of the present pixel. Herein, when a carry occurs, a gray-level to be displayed is varied.

However, in the above-mentioned Floid-Steinberg algorithm, errors of the present horizontal line pixels may be transmitted to pixels in a next horizontal line, in the worst case, because errors of pixels on the first line on a screen may affect errors of the last line pixels, an abnormal gray-level occurs on the screen. In more detail, a pattern on the screen is divided into figures having various shapes. For example, when regions divided into a vehicle, sky and people, etc. are displayed on one screen, an error of pixels in a vehicle region may affect bad influence to a gray-level implement of pixels in a people region placed far away from it on the screen.

In addition, because the Floid-Steinberg algorithm respectively performs an error diffusion by R (red), G (green), B (blue), a severe noise may occur. In more detail, when an error of RGB cells on the first horizontal line is different each other, the error is transmitted to the last horizontal line, a carry occurrence of the RGB cells on the last horizontal line is differed, if pixels of the last line are gray-level, on the actual screen a color can be shown. Accordingly, due to the above-mentioned problems, the Floid-Steinberg algorithm can not be used for a present display device required to have a high picture quality.

SUMMARY OF THE INVENTION

Accordingly, it is an object of the present invention to provide an error diffusion method and an apparatus thereof for a display system which are capable of preventing errors of pixels in a specific display region from affecting pixels in other display regions on a PDP (plasma display panel) device or other display devices.

In order to achieve the above-mentioned object, an error diffusion apparatus includes a boundary region recognition unit for recognizing boundaries of displayed regions by a RGB (red, green, blue) input signal and outputting a boundary recognition signal and an error diffusion processing unit for outputting a RGB output signal by computing an error value between a present pixel and surrounding pixels or outputting a RGB output signal by computing only an error value of the present pixel in accordance with the boundary region recognition signal.

An error diffusion method for a display system includes computing an error value between a present pixel and surrounding pixels by recognizing displayed boundaries by a RGB (red, green, blue) input signal or computing only an error value of the present pixel and implementing a gray-level on a display.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiments of an error diffusion method and an apparatus thereof for a display system which are capable of preventing errors of pixels of a certain display regions for affecting pixels of other display regions on a PDP (plasma display panel) device or other display devices will be described in detail with reference to accompanying drawings.

Figure 1:
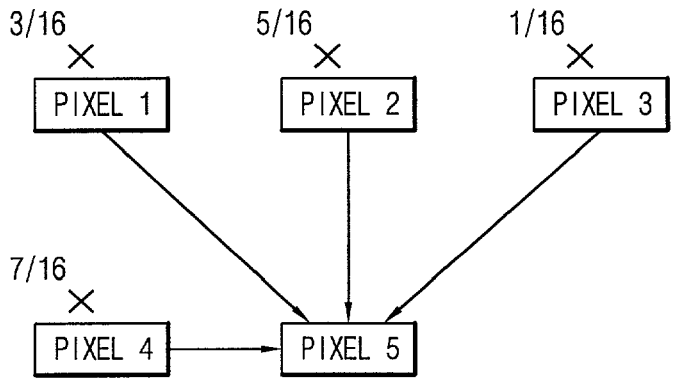
FIG. 1 CONVENTIONAL ART
FIG. 1 is an examplary view illustrating an error diffusion applying a Floid-Steinberg algorithm.
Figure 2:
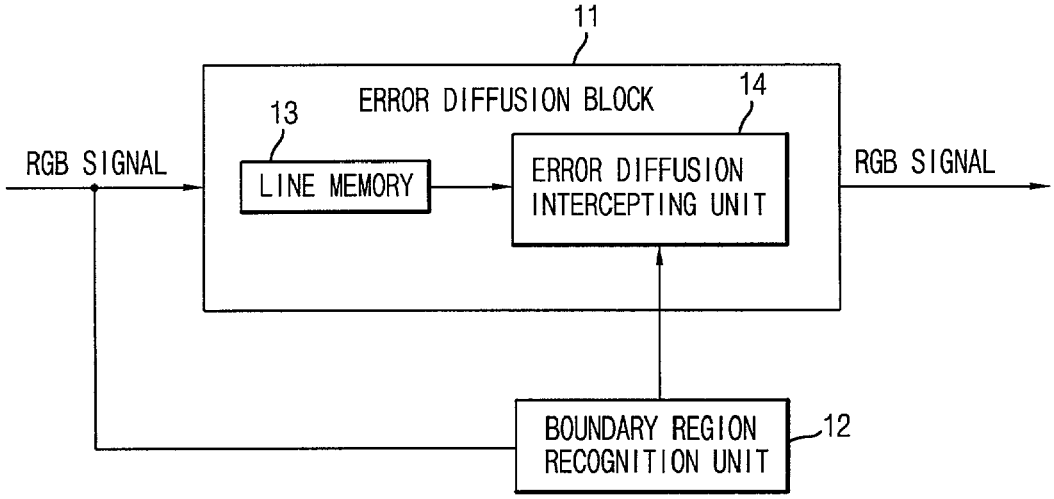
FIG. 2 is a block diagram illustrating an error diffusion apparatus for a display system in accordance with the present invention.

FIG. 2 is a block diagram illustrating an error diffusion apparatus for a display system in accordance with the present invention.

As depicted in FIG. 2, an error diffusion apparatus for a display system includes an error diffusion block 11 implementing a gray-level on a display by outputting a RGB output signal by computing an error value between a present pixel and surrounding pixels by adapting a Floid-Steinberg algorithm to a R (red), G (green), B (blue) input signal, a boundary region recognition unit 12 recognizing boundaries of display regions by the RGB signal and outputting a boundary recognition signal, a line memory 13 arranged inside the error diffusion processing unit 11 and storing error data of each pixel, and an error diffusion intercepting unit 14 arranged inside the error diffusion processing unit 11 and selectively outputting error data and zero data of each pixel stored in the line memory 13 according to the boundary recognition signal in order to control outputting of a RGB output signal obtained by computing an error value between a present pixel and surrounding pixels or computing only an error value of a present pixel in the error diffusion processing unit 11.

Herein, the error diffusion processing unit 11 outputs a RGB output signal by computing an error value between a present pixel and surrounding pixels or computing only an error value of the present pixel according to the boundary region recognition signal so as not to be affected by error values of other display regions.

In addition, various methods can be applied to the boundary region recognition unit 12 in order to recognize boundaries of displayed regions, however it is preferable to apply a simple method to satisfy a real-time processing of a display device, the preferred three embodiments will be presented. Hereinafter, an error diffusion method and an apparatus thereof for a display system in accordance with the present invention will be described in more detail. In addition, the three embodiments (a first~a third embodiments) will be described in detail with reference to accompanying FIGS. 3~5.

Figure 3:
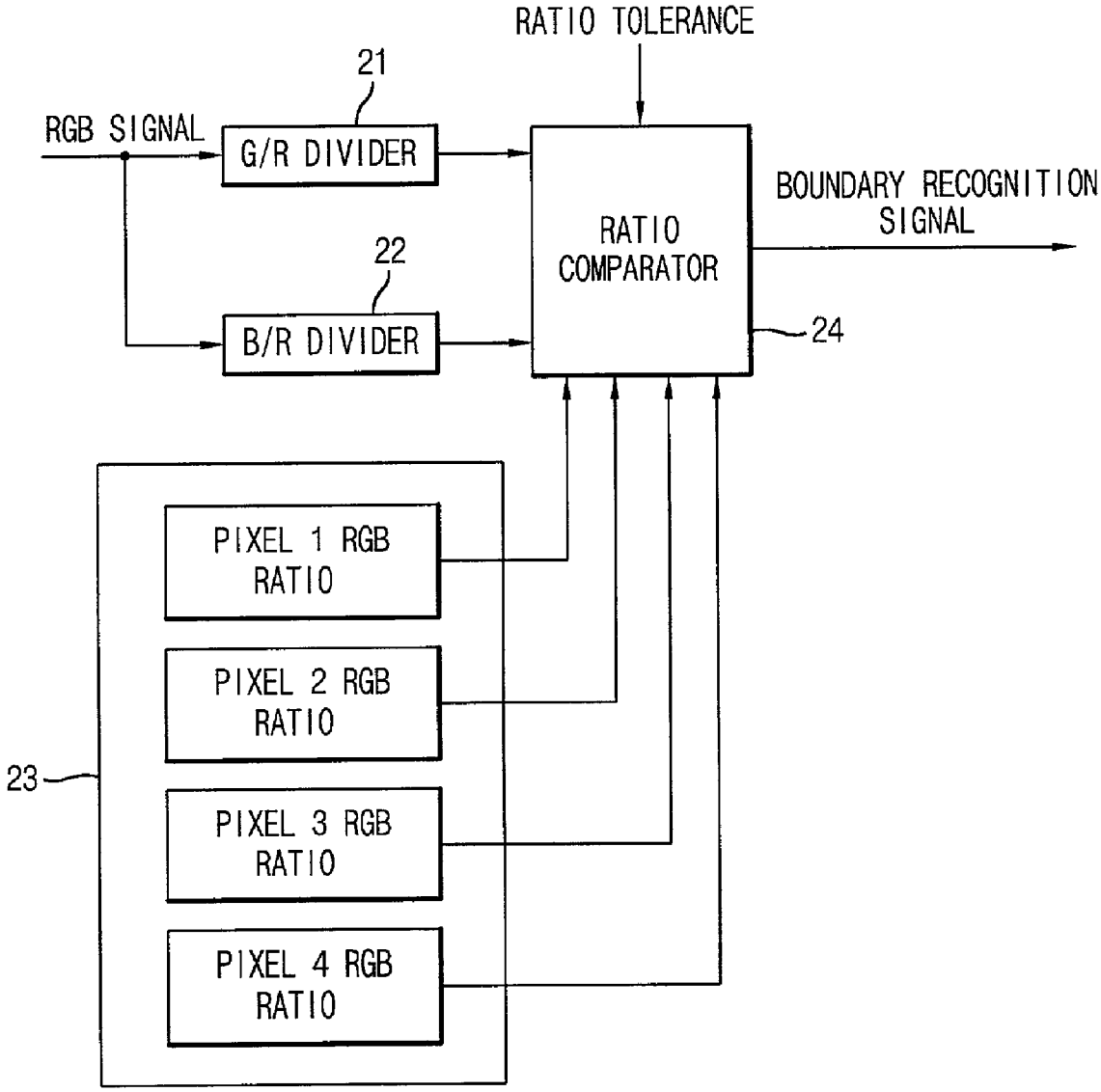
FIG. 3 is a block diagram illustrating a first embodiment of a boundary region recognition unit in accordance with the present invention.

FIG. 3 is a block diagram illustrating a first embodiment of a boundary region recognition unit in accordance with the present invention.

As depicted in FIG. 3, the boundary region recognition unit 12 includes a G (green)/R (red) divider 21 and a B (blue)/R (red) divider 22 calculating a ratio of RGB to a present pixel from a RGB signal, a memory unit 23 storing a ratio of RGB to surrounding pixels, and a ratio comparator 24 comparing the ratio of RGB to the present pixel calculated by the G/R divider 21 and the B/R divider 22 with the ratio of RGB to the surrounding pixels stored in the memory unit 23 and enabling or disabling the operation of a boundary recognition signal according to a comparison result whether a comparison value exceeds a ratio tolerance set by a user.

In the first embodiment of the boundary region recognition unit 12, a ratio of RGB to a present pixel is compared with a ratio of RGB to surrounding pixels, when a comparison value satisfies a ratio tolerance set by a user, it is recognized as the same region, when the comparison value does not satisfy the ratio tolerance, it is recognized as another region. For example, in a present region having a gray-level ratio as 1:20:100 and a surrounding region having a gray-level ratio as 1:30:150, when there is a ratio tolerance of R:G as 10 and R:B as 10, a difference between the present region and the surrounding region is greater than 10, it is judged as another region, accordingly the boundary recognition signal is enabled.

Figure 4:
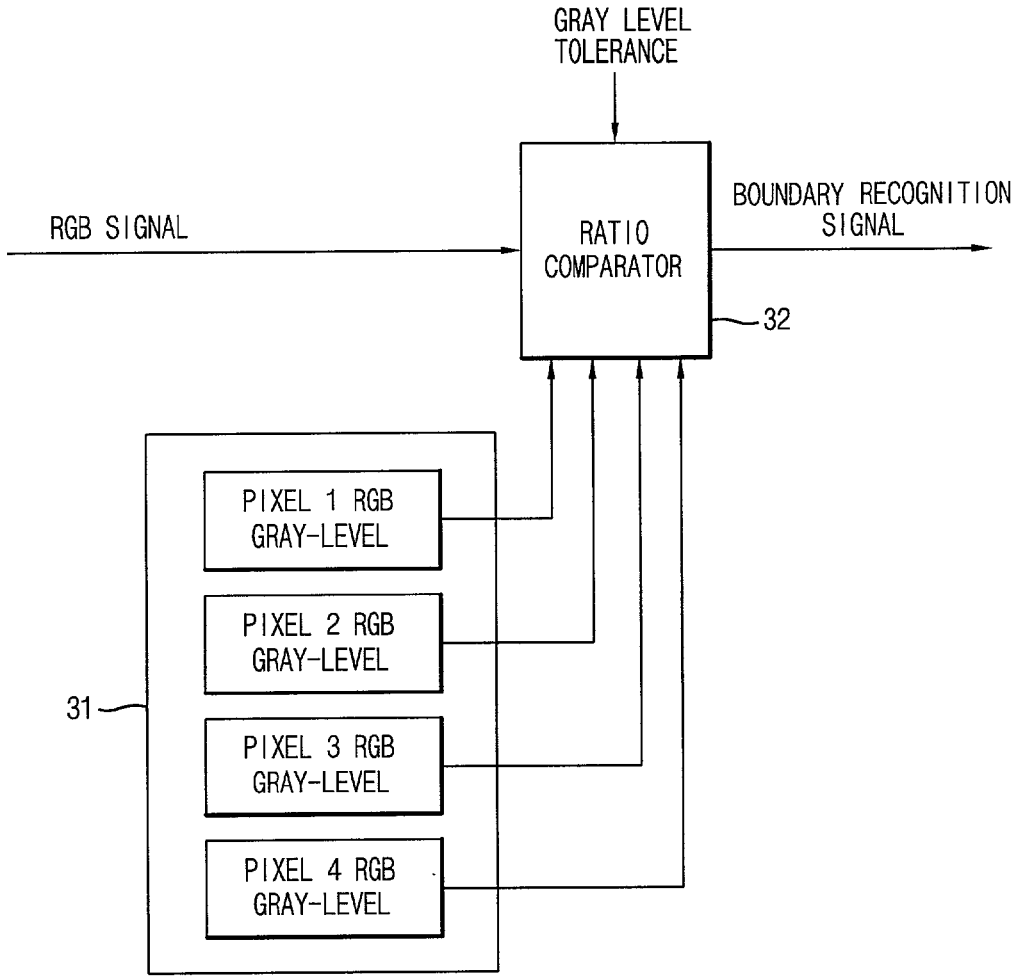
FIG. 4 is a block diagram illustrating a second embodiment of a boundary region recognition unit in accordance with the present invention.

FIG. 4 is a block diagram illustrating a second embodiment of a boundary region recognition unit in accordance with the present invention.

As depicted in FIG. 4, the boundary region recognition unit 12 includes a memory unit 31 for storing an absolute gray-level of a surrounding pixel and a gray-level comparator 32 receiving an absolute gray level value of a present pixel from a RGB signal, receiving an absolute gray-level value of a surrounding pixel from the memory unit 31, comparing them and enabling or disabling the operation of a boundary recognition signal as an output signal in accordance with the comparison result whether a comparison value exceeds a gray-level tolerance set by a user.

In the second embodiment of the boundary region recognition unit 12, an absolute gray-level of a present pixel is compared with an absolute gray-level of a surrounding pixel, when it satisfies a gray-level tolerance set by a user, it is recognized as the same region, when it does not satisfy the gray-level tolerance set by the user, it is recognized as another region. For example, when an absolute gray-level value of a present pixel is 20 and a gray-level tolerance is 10, if a pixel having a gray-level not greater than 10 or not less than 30 is recognized, it is recognized as another region, accordingly the boundary recognition signal is enabled.

Figure 5:
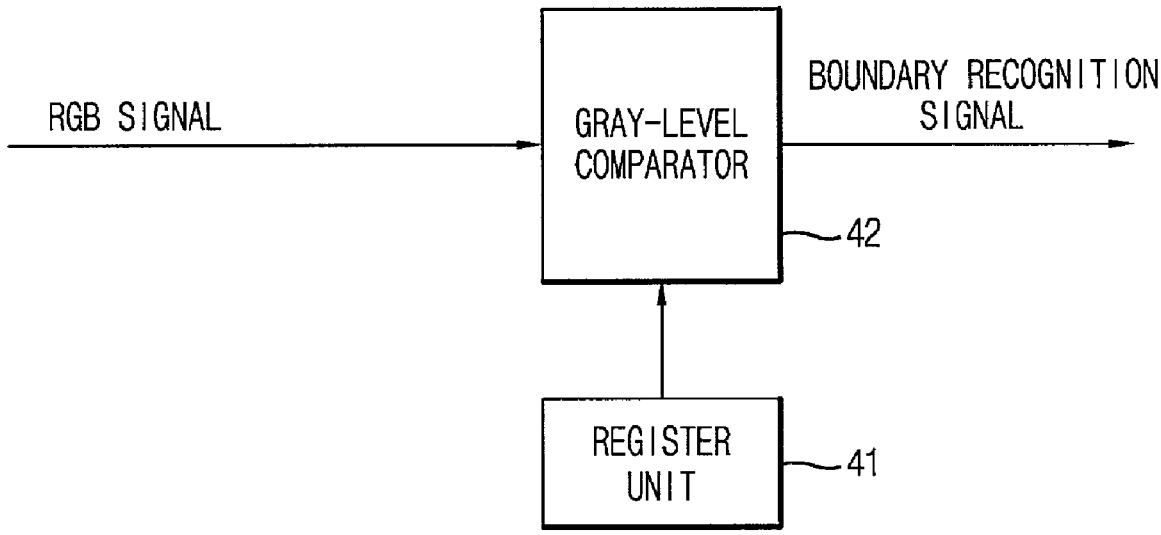
FIG. 5 is a block diagram illustrating a third embodiment of a boundary region recognition unit in accordance with the present invention.

FIG. 5 is a block diagram illustrating a third embodiment of a boundary region recognition unit in accordance with the present invention.

As depicted in FIG. 5, the boundary region recognition unit 12 includes a register unit 41 storing a high gray-level threshold value and a gray-level comparator 42 enabling or disabling the operation of a boundary region recognition signal as an output signal by judging whether the high gray-level value from the RGB signal exceeds the high gray-level threshold value inputted from the register unit 41.

In the third embodiment of the boundary region recognition unit 12, in a high gray-level, variation of a gray-level due to an error is insignificant in a brightness of a gray-level to be implemented, it has little effect on visual aspects. Accordingly, when the high gray-level value exceeds the high gray-level threshold value, it is recognized as another region, and the boundary region recognition signal is enabled.

After that, the boundary region recognition unit 12 recognizes boundaries of displayed regions, when the boundary region recognition signal is enabled, the error diffusion intercepting unit 14 selectively outputs zero data between error data and zero data of each pixel stored in the line memory 13 to control the error diffusion processing unit 11 so as to output a RGB output signal by computing only an error value of a present pixel.

Hereinafter, the error diffusion intercepting unit 14 will be described in detail with reference to accompanying FIG. 6.

Figure 6:
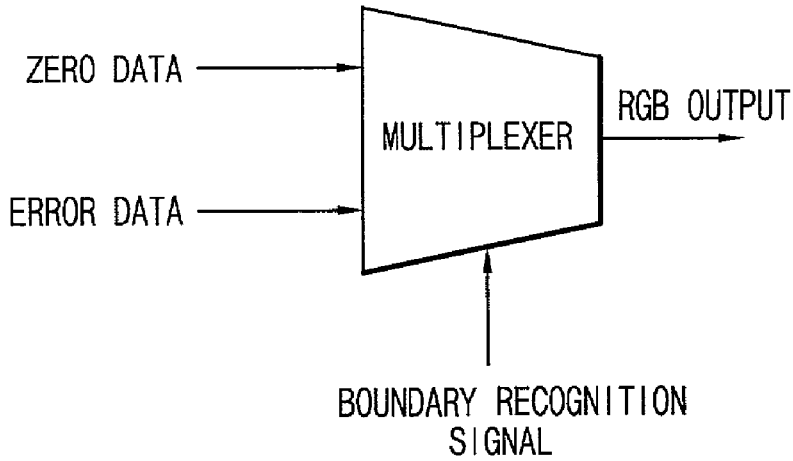
FIG. 6 is a block diagram illustrating an error diffusion intercepting unit in accordance with the present invention.

FIG. 6 is a block diagram illustrating an error diffusion intercepting unit in accordance with the present invention.

As depicted in FIG. 6, by selectively outputting error data and zero data of the line memory 13 by receiving a boundary region recognition signal from the boundary region recognition unit 12, a multiplexer of the error diffusion intercepting unit 14 controls the error diffusion processing unit 11 to output a RGB output signal by computing an error value between a present pixel and surrounding pixels or by computing only an error value of a present pixel.

As described above, an error diffusion method and an apparatus thereof for a display system in accordance with the present invention are capable of preventing an error of pixels in a specific display region from affecting pixels in other display regions by outputting a RGB output signal by computing an error value between a present pixel and surrounding pixels or by computing only an error value of a present pixel regardless of an error of surrounding pixels by an error diffusion processing unit 11 in accordance with a boundary region recognition signal.

In addition, in an error diffusion method and an apparatus thereof for a display system in accordance with the present invention, by respectively performing an error diffusion by display regions by preventing an error in a specific display region from affecting pixels in other display regions, a required gray-level can be accurately obtained without any noise.

In addition, an error diffusion method and an apparatus thereof for a display system in accordance with the present invention can be applied to a display device required to have a high picture quality.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An error diffusion apparatus, comprising:

a boundary region recognition unit for recognizing boundaries of displayed regions by a single scalar RGB (red, green, blue) input signal; and an error diffusion processing unit for outputting a single scalar RGB output signal by performing at least one of computing an error value between a present pixel and surrounding pixels based on the recognized boundaries and outputting a single scalar RGB output signal by computing an error value of the present pixel based on the recognized boundaries, the error value of the present pixel computed regardless of an error of the surrounding pixels, wherein the boundary region recognition unit enables or disables operation of a boundary region recognition signal corresponding to the recognized boundaries, wherein the boundary region recognition unit compares a ratio R:G:B of the present pixel with a ratio R:G:B of the surrounding pixel and one of enables and disables the operation of the boundary region recognition signal according to whether a comparison value exceeds a ratio tolerance set by a user, and wherein the boundary region recognition unit receives an absolute gray-level value of the present pixel from the RGB input signal and an absolute gray-level value of the surrounding pixel, compares them, and one of enables or and disables the operation of the boundary region recognition signal according to a comparison result whether a comparison value exceeds a gray-level tolerance set by a user.

2. The apparatus of claim 1, wherein the error diffusion processing unit implements a gray-level on a display by outputting the RGB output signal.

3. The apparatus of claim 1, wherein the error diffusion processing unit computes error values of the present pixel and the surrounding pixels by applying an error diffusion algorithm to the RGB input signal.

4. The apparatus of claim 1, wherein the boundry region recognition unit comprises:

a divider for calculating a ratio of RGB to the present pixel from the RGB input signal;

a memory unit for storing a ratio of RGB to the surrounding pixel; and a ratio comparator for comparing the ratio of RGB to the present pixel inputted from the divider with the ratio of RGB to the surrounding pixel stored in the memory unit and one of enabling and disabling the operation of the boundry region recognition signal according to a comparison result whether a comparison value exceeds a ratio tolerance set by a user.

5. The apparatus of claim 4, wherein the boundary region recognition unit comprises:

a memory unit for storing an absolute gray-level value of the surrounding pixel; and a gray-level comparator for receiving an absolute gray-level value of the surrounding pixel from the memory unit, comparing them, and one of enabling and disabling the operation of the boundary region recognition signal according to whether a comparison value exceeds a gray-level tolerance set by a user.

6. The apparatus of claim 4, wherein the boundary region recognition unit one of enables and disables the operation of the boundary region recognition signal by judging whether a high gray-level value of the pixel from the RGB input signal exceeds a high gray-level threshold value.

7. The apparatus of claim 4, wherein the boundary region recognition unit comprises:

a register unit for storing a high gray-level threshold value; and a gray-level comparator for one of enabling and disabling the operation of the boundary region recognition signal by judging whether a high gray-level value of the pixel from the RGB input signal exceeds a high gray-level threshold value stored in the register unit.

8. The apparatus of claim 1, further comprising:

an error diffusion intercepting unit for controlling the error diffusion processing unit to output a RGB output signal by one of computing an error value between the present pixel and the surrounding pixels and outputting a single scalar RGB output signal by computing only an error value of the present pixel regardless of errors of the surrounding pixels.

9. The apparatus of claim 8, wherein the error diffusion intercepting unit comprises a multiplexer for controlling the error diffusion processing unit to output a single scalar RGB output signal by one of computing an error value between the present pixel and the surrounding pixels and outputting a single scalar RGB output signal by computing only an error value of the present pixel regardless of errors of the surrounding pixels.

10. The apparatus of claim 9, wherein the error diffusion processing unit further comprises a line memory for storing error data of each pixel.

11. In an apparatus for outputting a single scalar RGB output signal by computing an error value between a present pixel and surrounding pixels by a single scalar RGB (red, green, blue) input signal, an error diffusion apparatus for a display system, comprising:

a boundary region recognition unit for recognizing boundaries of displayed regions from the single scalar RGB input signal and outputting a boundary region recognition signal;

an error diffusion intercepting unit for outputting a control signal to select RGB output signals according to the boundary region recognition signal; and an error diffusion processing unit for outputting a single scalar RGB output signal by at least performing one of computing an error value between a present pixel and surrounding pixels based on the control signal and outputting a single scalar RGB output signal by computing an error value of the present pixel based on the control signal, the error value of the present pixel computed regardless of an error of the surrounding pixels, wherein the boundary region recognition unit comprises:

a divider for calculating a ratio of RGB to the present pixel from the RGB input signal;

a memory unit for storing a ratio of RGB to the surrounding pixels; and a ratio comparator for comparing a ratio of RGB to present pixel inputted from the divider with a ratio of RGB to the surrounding pixels stored in the memory unit and one of enabling and disabling the operation of the boundary region recognition signal according to whether a comparison value exceeds a ratio tolerance set by a user.

12. The apparatus of claim 11, wherein the boundary region recognition unit comprises:

a memory unit for storing an absolute gray-level value of the surrounding pixel; and a gray-level comparator for receiving an absolute gray-level value of a present pixel from the single scalar RGB input signal, receiving an absolute gray-level value of the surrounding pixel from the memory unit, comparing the absolute gray-level value of the present pixel to the absolute gray-level value of the surrounding pixel, and one of enabling and disabling the operation of the boundary region recognition signal according to whether a comparison value exceeds a gray-level tolerance set by a user.

13. The apparatus of claim 11, wherein the boundary region recognition unit comprises:

a register unit for storing a high gray-level threshold value; and a gray-level comparator for comparing a high gray-level value of pixels from the single scalar RGB input signal with the high gray-level threshold value stored in the register unit and one of enabling and disabling the operation of the boundary region recognition signal according to a comparison result.

14. The apparatus of claim 11, wherein the error diffusion intercepting unit comprises a multiplexer for controlling the error diffusion processing unit to output a single scalar RGB output signal by one of computing an error value between the present pixel and the surrounding pixels and outputting a single scalar RGB output signal by computing only an error value of the present pixel regardless of errors of the surrounding pixels.

15. An error diffusion method for a display system, comprising:

computing an error value between a present pixel and surrounding pixels by one of recognizing displayed boundries by a single scaler RGB (red,green,blue) input signal and computing an error value of the present pixel based on the recognized boundries and regardless of an error of the surrounding pixels; and implementing a gray-level on a display by outputting a single scaler RGB output signal based on the computed error value, wherein the computing step comprises comparing a ratio R:G:B of the present pixel with a ratio R:G:B of the surrounding pixels and one of computing an error value between the present pixel and the surrounding pixels and computing an error value of the present pixel according to whether a comparison value exceeds a ratio tolerance set by a user, and wherein the computing step comprises comparing an absolute gray-level value of the present pixel with an absolute gray-level value of the surrounding pixels from the single scaler RGB input signal and one of computing an error value between the present pixel and the surrounding pixels and computing only an error value of the present pixel according to whether a comparison value exceeds a ratio tolerance set by a user.

16. The method of claim 15, wherein the computing step comprises one of computing-an error value between the present pixel and the surrounding pixels and computing only an error value of the present pixel so as not to be affected by an error value of pixels in other display regions by judging whether a high gray-level value of the pixels from the single scalar RGB input signal exceeds a high gray-level threshold value.

* * * * *